United States Patent [19]

Dean

[11] 3,962,960

[45] June 15, 1976

[54] VERTICAL DISCHARGE SLOT DIFFUSER WITH HIGH INDUCTION RATIO

[75] Inventor: Frank J. Dean, Kansas City, Mo.

[73] Assignee: Tempmaster Corporation, Kansas City, Mo.

[22] Filed: Feb. 5, 1975

[21] Appl. No.: 547,174

Related U.S. Application Data

[63] Continuation of Ser. No. 428,333, Dec. 26, 1973, abandoned.

[52] U.S. Cl. ..... 98/40 C; 239/601; 98/36

[51] Int. Cl.[2] ..... F24F 13/06

[58] Field of Search..... 98/40 D, 40 N, 36, 40 C; 236/49; 237/50, 81; 239/601; 417/196, 151

[56] References Cited

UNITED STATES PATENTS

| | | | |
|---|---|---|---|
| 1,449,504 | 3/1923 | Ehrhart | 417/196 X |
| 2,182,690 | 12/1939 | Cole | 98/39 |
| 2,434,340 | 1/1948 | Wallen et al. | 98/40 N X |
| 2,977,870 | 4/1961 | Bierwirth et al. | 98/40 C |
| 3,575,234 | 4/1971 | Dieckmann | 98/40 N |
| 3,667,069 | 6/1972 | Blackshear et al. | 417/196 X |
| 3,730,071 | 5/1973 | Gutheim | 98/40 D |
| 3,768,394 | 10/1973 | Powlesland | 98/36 |

FOREIGN PATENTS OR APPLICATIONS

| | | | |
|---|---|---|---|
| 564,156 | 10/1932 | Germany | 98/40 D |

*Primary Examiner*—William E. Wayner
*Attorney, Agent, or Firm*—Lowe, Kokjer, Kircher

[57] ABSTRACT

A slot diffuser is utilized to counteract large heat losses through a wall or window by producing a vertical blanket or curtain of air adjacent the wall or window. An elongate housing defines a plenum chamber delivering air to a uniquely constructed convergent-divergent diffuser slot. High velocity air exits from the diffuser slot and is rapidly intermixed with the induced cold air from the wall or window. The rapid mixing, resulting from the high discharge velocity, permits very hot air to be introduced into the room, yielding a high induction ratio so that a small volume of air counteracts a high rate of heat leakage. The specially shaped diffuser slot performs relatively noiselessly while permitting high velocity air to flow therethrough.

2 Claims, 3 Drawing Figures

VERTICAL DISCHARGE SLOT DIFFUSER WITH HIGH INDUCTION RATIO

This is a continuation of application Ser. No 428,333, filed Dec. 26, 1973, now abandoned.

BACKGROUND AND SUMMARY OF THE INVENTION

This invention relates generally to a vertical discharge slot diffuser utilized to reduce the effect of large heat losses through walls, windows and the like, and more particularly to a diffuser that requires only a small quantity of air to counteract such thermal leakage.

When a low outside temperature exists, it is not uncommon for the average heat loss through the walls and windows of a building to exceed 400 BTUs per linear foot. Attempts to lower the rates of heat loss have included conventional perimeter air distribution systems which blow hot air introduced at the ceiling away from the wall to induce cold air in an upward direction. With greater wall losses, the usual practice is to utilize a distributing unit that directs warm air upwardly from the floor or from a soffit located beneath the window. The primary problem associated with existing floor mounted units is that a large volume of air is needed in order to effectively counteract the high rate of thermal leakage which can in turn result in excessive operating costs.

It is frequently undesirable to mount a unit on the floor because the ductwork must penetrate the floor slab and a high installation cost sometimes results. Therefore, distribution systems have been developed that utilize a plurality of ceiling mounted diffusers to direct warm air downwardly. Again, however, such systems require a large volume of air to effectively offset large wall losses. Furthermore, diffuser systems produce a weak Coanda effect and the air flowing from the diffuser does not properly hug the wall, thereby creating drafts of warm air that cause discomfort to persons in the room.

To overcome these problems, this invention is adapted to be either sill mounted or mounted above the false ceiling of the room, where it may be easily installed and where it does not occupy valuable space within the room. In addition, since the diffuser is located adjacent to a wall, the blanket of air produced tends to hug the wall. This wall attachment principle, known as the Coanda effect, is well known in the science of fluidics or fluid logic and is particularly useful in air circulation systems. The utilization of a continuous, vertically directed slot results in the maximum Coanda effect, thereby causing the air curtain to remain near the wall so as not to produce undesirable drafts in the occupied part of the room.

An important advantage of this invention is that it effectively counteracts high rates of heat loss while requiring only a small quantity of hot air. Accordingly, the attached ducts may be relatively small and installation costs are therefore substantially reduced. Since the diffuser discharges air at a velocity more than twice as great as the velocity from conventional diffusers, the hot air from the diffuser is much more rapidly mixed with the cold air adjacent to the wall or window. The rapid mixing process thereby obtained allows a small amount of air to be introduced at a high temperature, resulting in a high induction ratio—approximately 1 cubic foot of air from the diffuser mixes with 4 cubic feet of room air to effectively counteract a high rate of heat loss. Moreover, if the diffuser is mounted on the ceiling, the heat from the introduced air is dissipated before reaching the occupied area near the floor, and the resulting air mixture approaches room temperature prior to contacting the occupants of the room. Therefore, any discomfort caused by warm air currents is avoided.

It should also be noted that the slot air construction utilized herewith creates a downward or upward flow in a vertical direction with a minimum amount of turbulence being imparted to the discharged air. As a result of the novel streamlined slot construction, the noise is minimized while at the same time a space is provided for the induced air to curl back into the high velocity low volume discharge and deposit any dirt in the induced air on the diffuser rather than on the adjacent ceiling or sill.

A primary object of this invention is to counteract heat leakage through walls, windows and the like by providing an air diffuser that requires a relatively small quantity of air to effectively perform its function. This feature is achieved by discharging high temperature air from the diffuser at a high velocity to produce a rapid intermixing of the hot air with the cold air leaking into the room.

Another primary object of the invention is to provide a diffuser of the character described that operates relatively noiselessly.

Yet another object of this invention is to provide a diffuser of the character described that has a vertically directed discharge slot located adjacent a wall or window so as to obtain maximum advantage from the Coanda effect.

A further object of this invention is to provide a diffuser of the character described that may be mounted on either the ceiling or sill and discharge air vertically either downwardly or upwardly.

Other and further objects of the invention, together with the features of novelty appurtenant thereto, will appear in the course of the following description.

Detailed Description of the Invention

In the accompanying drawings, which form a part of the specification and are to be read in conjunction therewith, and in which like reference numerals are utilized to indicate like parts in the various views.

Figure 1:
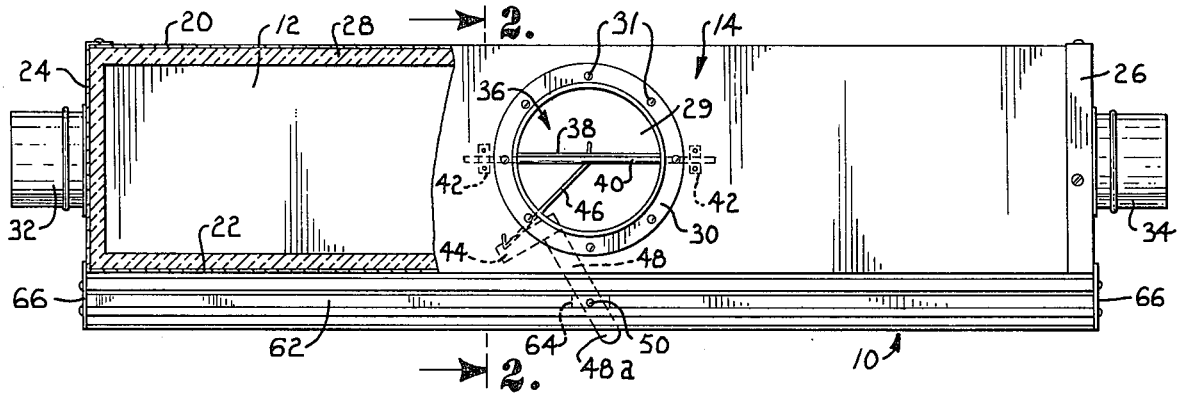
FIG. 1 is a side elevational view of a preferred embodiment of the vertical discharge slot diffuser, a portion of the housing being shown in cross section.

Referring now to the drawings in more detail, a single slot diffuser device is generally designated by reference numeral 10. Diffuser 10 may be mounted on the T-bars (not shown) conventionally hung from the true structural ceiling to form support for a false ceiling. In addition, the diffuser may be otherwise supported above the ceiling panels comprising the false ceiling by hanger wires suspended from the true ceiling. Alternatively, diffuser 10 may be mounted beneath the floor (or window sill) with its slot disposed upwardly. In any event, diffuser 10 is usually horizontally mounted with its single discharge slot located approximately 1 foot from the wall or window which it is to act upon. The discharge slot is disposed parallel to the wall, so that a blanket or curtain of air extends vertically from the diffuser adjacently to the surface of the affected wall or window.

A plenum chamber 12 is enclosed by an elongate housing structure 14 comprising a front wall 16, a rear wall 18, a top wall 20, a slotted bottom wall 22, and two end panels 24 and 26, all of which are suitably insulated as shown by the numeral 28. Front wall 16 has a circular inlet opening 29 for connection with a plenum inlet 30 attached thereto by a series of screws 31. End panels 24 and 26 may be provided with outlets 32 and 34 for attachment to outlet ductwork. The two outlets (32 and 34) may be used as optional connections to similar air slot diffusers. In this manner the effective length of the slot may be varied according to the interior structure.

To regulate the volume of air entering plenum chamber 12, a balancing damper assembly 36 may be furnished which includes a damper plate 38 connected to a pivotal rod 40 extending across front wall opening 29. Rod 40 is loosely mounted to the inner surface of front wall 16 by a pair of brackets 42 located on either side of opening 29. At a point near its inward periphery, damper plate 38 is connected to a linkage lever 44 by a damper control wire 46. Linkage lever 44 is rigidly attached to an adjustment lever 48, which in turn is pivotally pinned within the diffuser slot at 50.

Figure 2:
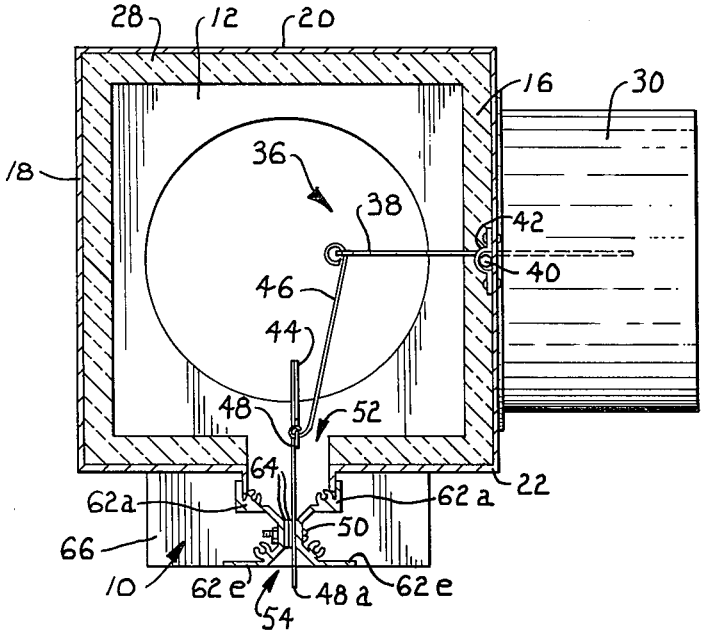
FIG. 2 is an enlarged end sectional view taken generally along line 2—2 of FIG. 1 in the direction of the arrows.
Figure 3:
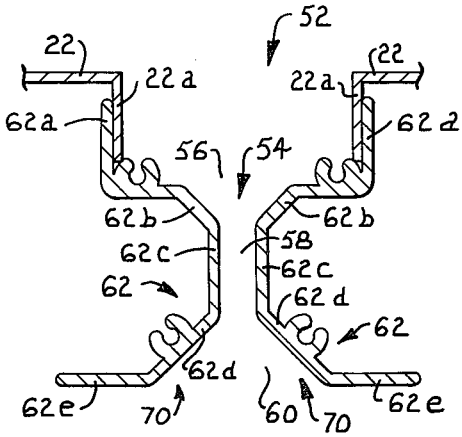
FIG. 3 is an enlarged fragmentary end sectional view of the discharge slot of the diffuser.

As shown in FIGS. 1 and 2, the lower end 48*a* of adjustment lever 48 protrudes below the diffuser assembly so that it may be manually manipulated. (In the position shown in FIGS. 1 and 2, damper assembly 36 is open to its fullest extent.) As adjustment lever end 48*a* is pushed to the left (FIG. 1), control wire 46 pivots damper plate 38 upwardly to partially close inlet opening 29. Damper plate 38 may be pivoted to a vertical position, thereby completely closing the inlet to plenum chamber 12, by continuing to push adjustment lever end 48*a* until it reaches its extreme leftward position.

The heated air travels out of plenum chamber 12 through a longitudinal opening 52 extending substantially the entire length of bottom wall 22. Communicating with longitudinal opening 52 is the diffuser slot 54, which includes an angular converging inlet 56, a throat 58, and a diverging outlet 60. Diffuser slot 54 is formed by a pair of spaced apart extrusions 62 having vertical flanged portions 62*a* attached to the downwardly extending flanges 22*a* of bottom wall 22. Extrusions 62 include sloping walls 62*b* defining the converging inlet 56, vertical walls 62*c* defining throat 58, diverging walls 62*d* defining the diverging outlet 60, and horizontal mounting flanges 62*e*. Extrusions 62 are rigidly spaced apart the desired distance to effect a uniform throat width by disposing one or more small spacer plates 64 between the extrusions at appropriate intervals along the length thereof. The two lateral extremities of diffuser slot 54 are covered by end plates 66, which slightly overlap the two end panels 24 and 26.

In operation, the protruding end portion 48*a* of adjustment lever 48 is set at the appropriate position wherein the desired volume of air flows into plenum chamber 12. The heated air enters the plenum chamber through inlet 30 and exits from the chamber through the diffuser slot 54, forming a blanket or curtain of air in a plane substantially parallel to the adjacent wall. The slot construction mentioned above, which defines throat 58, minimizes air turbulence therethrough and actually offers a minimum of resistance. As a result, laminar air flow is jetted downwardly (with the usual mounting technique) and a cavity 70 is effectively created between the principal air stream and the inner surfaces of the diverging walls 62*d*. These cavity areas permit the induced cold air to curl back into the diverging sides and to mix with the main air stream. The air curtain tends to be drawn toward the wall by the reduced pressure caused by the principal air flow. It has been empirically determined that the Coanda effect draws the air curtain about halfway to the wall so that the plane of motion is approximately 6 inches from the wall, an area in which any resulting draft is unlikely to affect anyone. Further, the distance provides ample room for aesthetic spacing of the diffuser structure.

The velocity of air exiting from slot 54 is dependent upon the air pressure in plenum chamber 12 and the width of throat area 58. With the pressure determined, an appropriate number of spacer plates 64 is utilized to produce a throat width yielding the desired air velocity. With respect to the ceiling mounted diffuser, it is preferred that the air velocity in the area near the floor be approximately 50 feet per minute which is within the range generally considered to be personally comfortable. In a room of typical height, this velocity near the floor is produced by a diffuser discharge velocity in the range of from 1500 to 2500 feet per minute, more than twice the discharge velocity of conventional diffusers.

Because of this relatively high air velocity, the hot air from diffuser 10 dissipates rapidly as it encounters the cooler air from the wall or window. Further, a high induction ratio results, e.g. approximately 1 cubic foot of air from the diffuser mixing with four cubic feet of air in the room. As a result of the high induction ratio obtained from the operation of diffuser 10, it is possible to introduce very hot air from the diffuser slot into the room. Thus, a small volume of high temperature air from the diffuser effectively counteracts a relatively high rate of heat loss through the adjacent wall or window without producing uncomfortable warm air drafts in the occupied area of the room. Further, the particular configuration and size of the diffuser slot with its converging inlet 56, restricted throat area 58, and diverging outlet 60 is uniquely capable of delivering a uniform flow of high velocity air without creating objectional noise as the air flows through slot 54.

From the foregoing, it will be seen that this invention is one well adapted to attain all of the ends and objects hereinabove set forth, together with other advantages which are obvious and which are inherent to the structure.

It will be understood that certain features and subcombinations are of utility and may be employed without reference to other features and subcombinations.

As many possible embodiments may be made of the invention without departing from the scope thereof, it is to be understood that all matter herein set forth or shown in the accompanying drawings is to be interpreted as illustrative and not in a limiting sense.

Having thus described my invention, I claim:

1. In an air diffuser device positionable near a wall or window to reduce the effect of thermal leakage through same, the improvement comprising:

a housing having an inlet suitable for connection with a source of conditioned air;

an elongate outlet slot extending substantially the length of said housing to direct air generally vertically therefrom, said outlet slot being of substantially uniform width;

a pair of substantially parallel flanges extending from said housing on opposite sides of said outlet slot to define the width thereof; and diffuser structure including:

a pair of substantially parallel flange sections secured to the respective flanges of said housing in overlapping relation therewith;

first wall portions coupled with said flange sections and spaced apart from one another, said first wall portions being angled to define a converging section for receiving air from said outlet slot;

second wall portions extending in spaced apart relation from said first wall portions, said second wall portions being substantially parallel to define a restricted throat section adjacent said conveying section; and third wall portions extending in spaced apart relation from said second wall portions, said third wall portions being angled to define a diverging discharge section adjacent said throat section, said wall portions each forming a substantial part of said diffuser structure and said diverging, throat and converging sections each being symmetrical with respect to a vertical plane passing therethrough.

2. The invention of claim 1, including a shiftable damper positioned in said housing to vary the effective cross sectional area thereof and mechanical linkage connected with said damper to effect shifting thereof, said linkage including a lever pivotally pinned in said throat section and projecting out of said diverging section.

* * * * *